US006089047A

United States Patent [19]

Wang

[11] Patent Number: 6,089,047

[45] Date of Patent: Jul. 18, 2000

[54] INNER PILE JACQUARD MECHANISM FOR A DOUBLE-LOOP TOWEL CIRCULAR KNITTING MACHINE

[75] Inventor: Ping-Shin Wang, Taipei Hsien, Taiwan

[73] Assignee: Pai Lung Machinery Mill Co., Ltd., Taipei Hsien, Taiwan

[21] Appl. No.: 09/396,359

[22] Filed: Sep. 15, 1999

[51] Int. Cl.[7] ..... D04B 15/06

[52] U.S. Cl. ..... 66/91; 66/107

[58] Field of Search ..... 66/19, 31, 20, 66/23, 25, 27, 91, 92, 93, 107, 217, 104

[56] References Cited

U.S. PATENT DOCUMENTS

| | | | |
|---|---|---|---|
| 3,477,255 | 11/1969 | Lombardi | 66/107 |
| 4,180,993 | 1/1980 | Phillip | 66/107 |
| 4,314,461 | 2/1982 | Conti | 66/107 |
| 4,519,221 | 5/1985 | Hirano | 66/107 |
| 5,511,393 | 4/1996 | Hu | 66/107 |

*Primary Examiner*—Larry Worrell
*Attorney, Agent, or Firm*—Bacon & Thomas, PLLC

[57] ABSTRACT

A double-loop towel may be knitted in either a pile loop or non-pile pattern by a circular knitting machine having an inner pile jacquard mechanism which includes a selector and a selection jack for controlling the knitting operation.

7 Claims, 13 Drawing Sheets

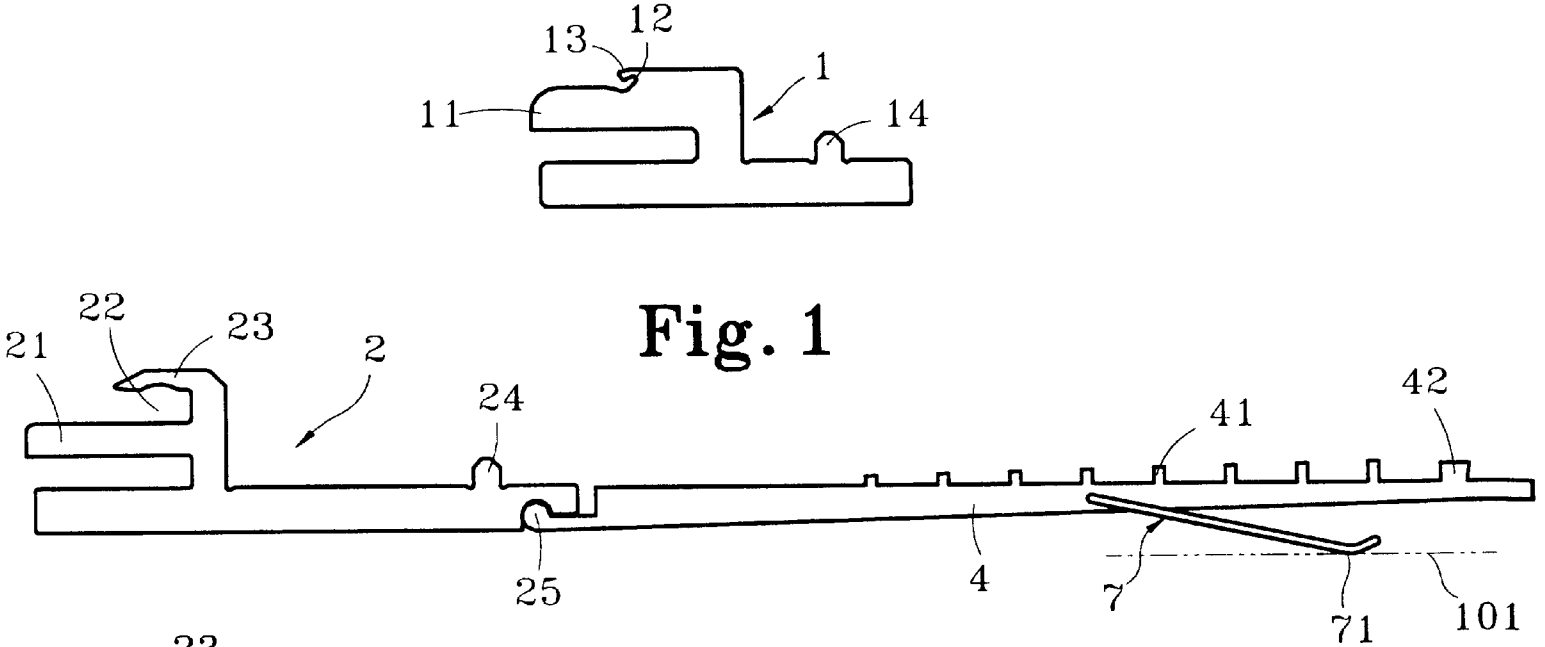
Fig. 1
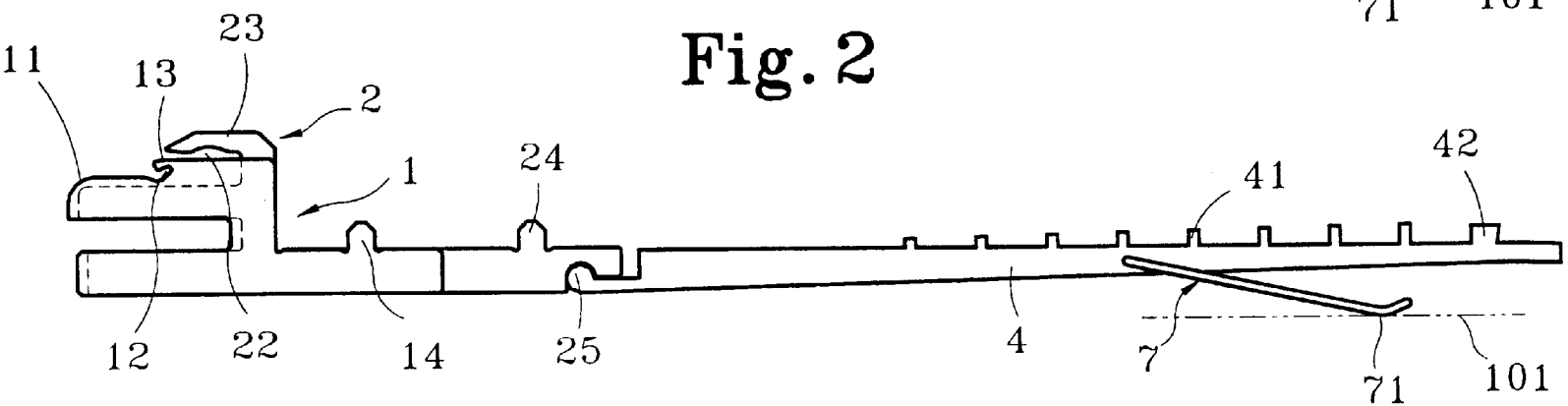
Fig. 2
Fig. 3

INNER PILE JACQUARD MECHANISM FOR A DOUBLE-LOOP TOWEL CIRCULAR KNITTING MACHINE

BACKGROUND OF THE INVENTION

The present invention relates to a double-loop towel circular knitting machine, and more specifically to an inner pile jacquard mechanism for a double-loop towel circular knitting machine.

In a regular double-loop towel circular knitting machine, the outer pile sinkers and the inner pile sinkers are arranged in pairs in a sinker cylinder, and a sinker cap is arranged on each pair of pile sinkers. The sinker cap has track means for pushing out the sinkers to knit a pile loop. During knitting, the sinkers are driven out by the sinker cap to match with a bottom knitting needle, so as to knit a double-loop towel. This structure of double-loop towel circular knitting machine can only knit a double-loop towel having a uniform pattern on both sides. When changing the pattern, the stroke of the outer pile sinkers and the stroke of the inner pile sinkers are respectively controlled. Actually, this knitting method can only change the size of the pile loops.

SUMMARY OF THE INVENTION

It is the main object of the present invention to provide an inner pile jacquard mechanism for a double-loop towel circular knitting machine, which can be controlled to knit pile loops, or a non-pile pattern. It is another object of the present invention to provide an inner pile jacquard mechanism for a double-loop towel circular knitting machine, which uses a selector and a selection jack to control pile-loop and non-pile pattern knitting operations, which selector can be a computer-controlled or electromagnetic valve type selector. It is another object of the present invention to provide an inner pile jacquard mechanism for a double-loop towel circular knitting machine, which uses a reset mechanism to reset the selection jack after each knitting cycle. According to the present invention, the inner pile jacquard mechanism comprises an inner pile sinker having a rear side, a selection jack pivoted to the rear side of the inner pile sinker, a push cam arranged on the selection jack and controlled to push out the inner pile sinker, and a selector arranged in the push cam and controlled to let the selection jack be pushed out by the push cam, wherein the inner pile of the double-loop towel is driven to knit a pile loop or non-pile pattern by controlling the selector to press or not to press on the selection jack.

BRIEF DESCRIPTION OF THE DRAWINGS

FIG. 1 illustrates the structure of an outer pile sinker according to the present invention.

FIG. 2 illustrates a selection jack pivoted to an outer pile sinker, and a reset mechanism arranged at the back of the selection jack according to the present invention.

FIG. 3 is similar to FIG. 2 but showing the outer pile sinker installed.

DETAILED DESCRIPTION OF THE PREFERRED EMBODIMENT

Figure 4A:
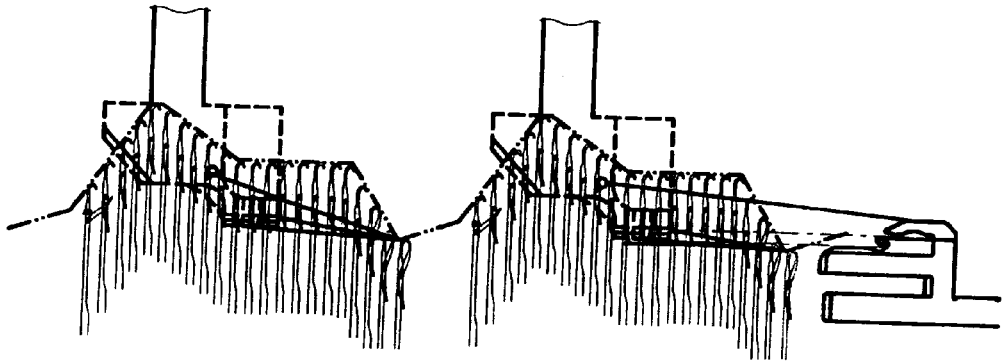
FIGS. 4A and 4B show the bottom knitting needle, the sinker cap, the outer pile sinker, the selector, and the push cam extended out according to the present invention.

Referring to the annexed drawings in detail, the present invention comprises an outer pile sinker 1, an inner pile sinker 2, a sinker cap 3 for driving the outer pile sinker 1 and the inner pile sinker 2, a selection jack 4 pivoted to the rear end of the inner pile sinker 2, a selector 5 for driving the selection jack 4, a push cam 6 for driving the selector 5, and a reset mechanism 7 arranged at the back of the selection jack 4.

The outer pile sinker 1 is arranged with the inner pile sinker 2 in one sliding groove in a sinker cylinder (not shown). The outer sinker 1 comprises a thick belly 11, a thin throat 12, a short nose 13, and a butt 14 near a rear side thereof. By means of the design of the throat 12 and the nose 13, the outer pile 8 and the ground yarn 10 can be smoothly matched with the bottom needle (not shown) and joined together to form or not to form a loop.

The inner pile sinker 2 comprises a thin belly 21, a thick throat 22, a long nose 23, a coupling portion 25 at a rear side thereof pivoted to the selection jack 4, and a butt 24 near the rear side. The design of the nose 23 enables the inner pile 9 and the ground yarn 10 to be matched with the bottom needle (not shown), and joined together to form or not to form a loop.

The sinker cap 3 comprises two guide tracks 31 and 32 for driving the outer pile sinker 1 and the inner pile sinker 2 to make pile-loops.

The selection jack 4 is one of a set of selection jacks of the circular knitting machine, having a front side pivoted to the coupling portion 25 of the inner pile sinker 2, a protruding portion 41 at a suitable location, and a butt 42 near a rear side thereof.

The selector 5 can be a computer-controlled or electromagnetic valve type selector, having a plurality of selector levers 51.

The push cam 6 comprises an actuating portion 61. When the selector 5 is not pressed on the protruding portion 41 of the selection jack 4, the butt 42 of the selection jack 4 is moved along the actuating portion 61 of the cam 6, thereby causing the selection jack 4 to be pushed to the loop hanging zone.

The reset mechanism 7 is formed of a spring plate arranged at the back of the selection jack 4, having a curved portion 71 pressed on the cylinder wall 101 of the sinker cylinder. When the selector 5 is operated, the selection jack 4 may be pressed. If the selection jack 4 is pressed, the reset mechanism 7 is forced against the cylinder wall 101, and a reset action must be achieved so that the selection jack can be extended out for enabling a next jacquard knitting cycle to be run. The selection jack 4 is extended out of the face of the needle cylinder, enabling the protruding portion 41 to enter the push cam 6, ready for a next jacquard knitting cycle. The aforesaid members form a double-loop towel inner pile jacquard mechanism.

The jacquard knitting operation includes seven steps. Normally, the outer pile sinker 1 and the inner pile sinker 2 are moved along the tracks at the sinker cap 3. When the selector 5 is operated, the outer pile sinker 1 and the inner pile sinker 2 are moved along the tracks at the push cam 6. The seven steps are outlined hereinafter with reference to FIGS. from 5A through 5J.

Figure 5A:
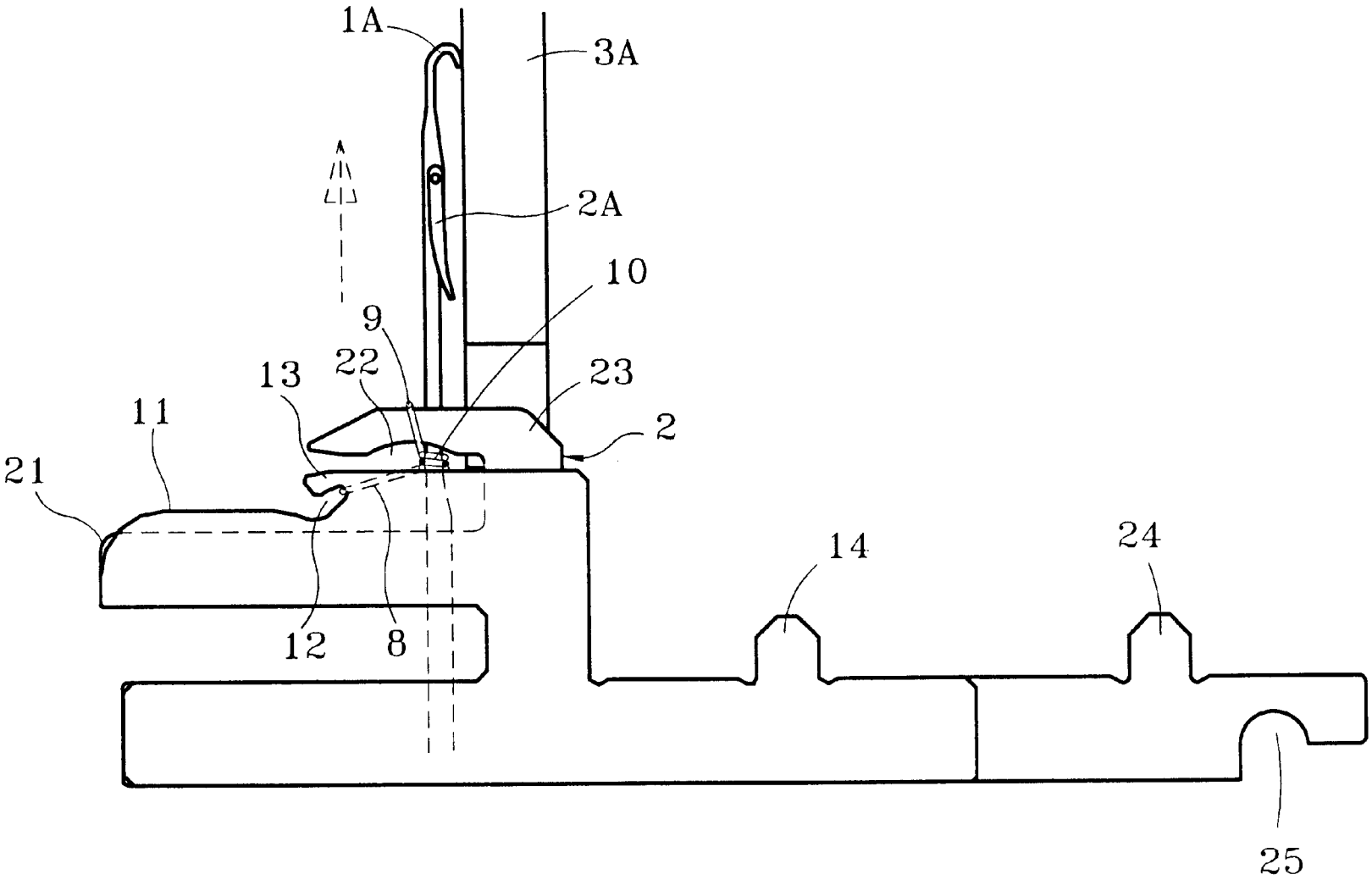
FIG. 5A illustrates a first knitting step of the double-loop towel knitting cycle according to the present invention.

At the first step, as shown in FIG. 5A, after last sinker ring, the knitting needle 1A is moving upwards, three loops 8, 9 and 10, which were hooked in the hook of the knitting needle 1A, push open the latch 2A of the knitting needle 1A, the inner pile sinker 2 and the outer pile sinker 1 must be pushed forward to hold down old loops. When the knitting needle 1A is continuously lifted before reaching the feeding plate 3A, the latch 2A must be fully opened to let retained loops be released. The knitting needle 1A reaches the topmost position when the latch 2A is fully opened. After having finished the fabric holding down work, the inner pile sinker 2 and the outer pile sinker 1 are moved back (further, the throat of the outer pile sinker presses the pile loop for a certain length of time, enabling the outer pile to be tightly fastened up with the ground yarn, therefore the timing of the sinker at this stage is relatively longer).

Figure 5B:
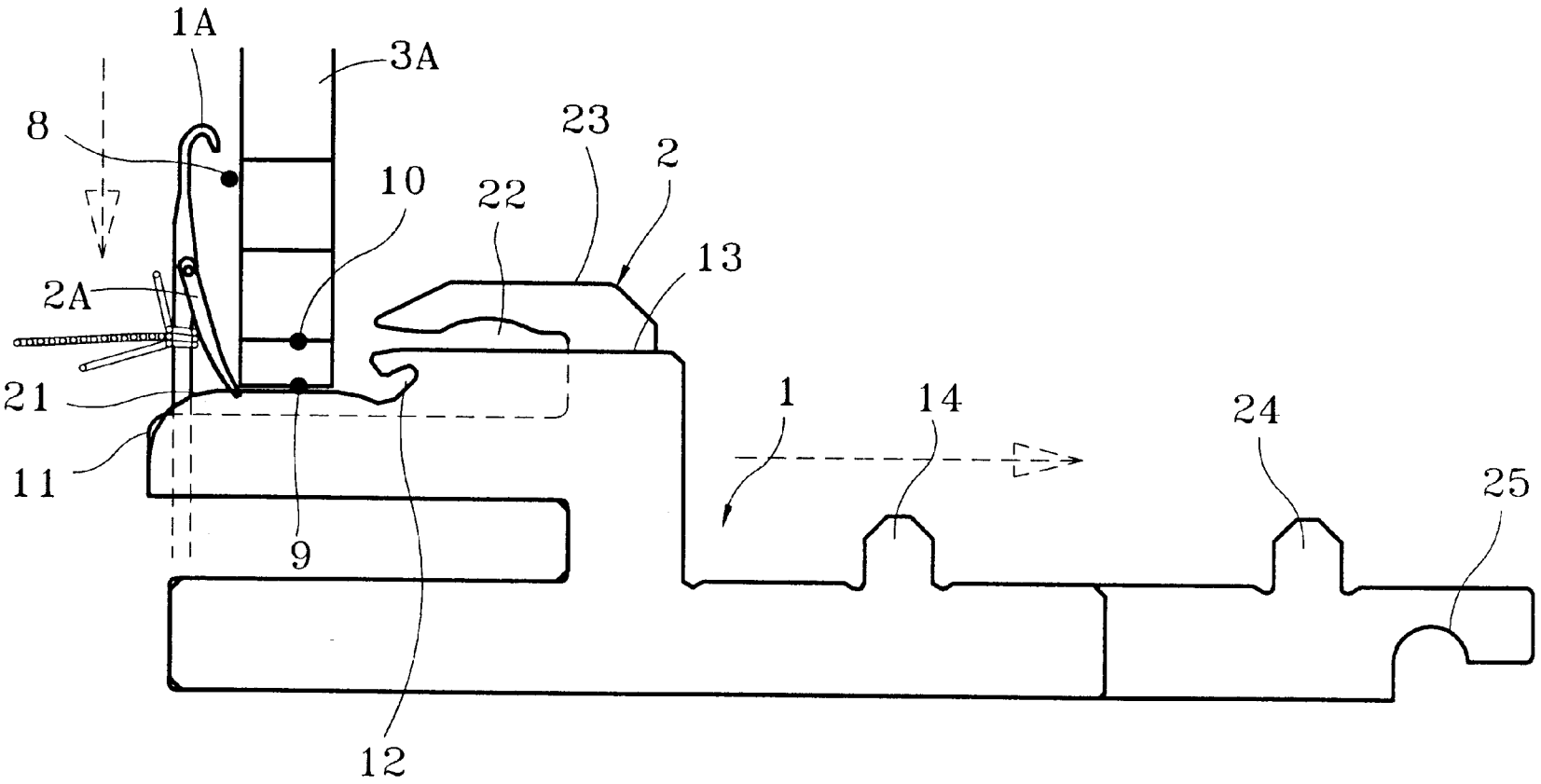
FIG. 5B illustrates a second knitting step of the double-loop towel knitting cycle according to the present invention.

At the second step, as shown in FIG. 5B, the knitting needle 1A is moved downwards to the yarn hooking position, the inner pile sinker 2 and the outer pile sinker 1 are moved back, enabling the yarns to be released from the throat 22 of the inner pile sinker 2 and the nose 13 and throat 12 of the outer pile sinker 1, therefore the pile loop is allowed to be slipped in. The inner pile 9 slides in the nose 23 of the inner pile sinker 2. The outer pile 8 slides through the throat 12 of the outer pile sinker 1 into the sinker slot, and the slides out of the sinker slot.

Figure 5C:
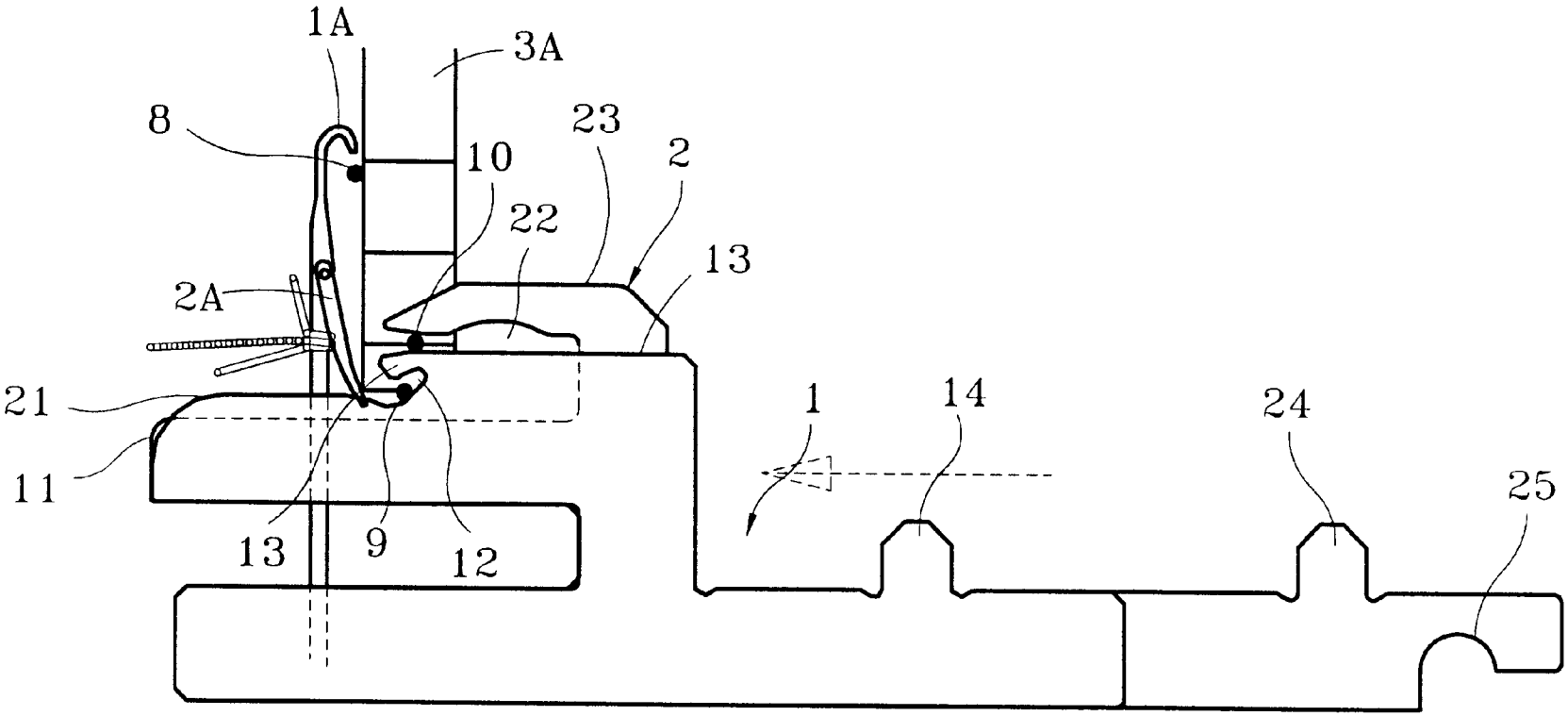
FIG. 5C illustrates a third knitting step of the double-loop towel knitting cycle according to the present invention.

At the third step, as shown in FIG. 5C, the timing at this stage is for allowing the pile loop to be positively positioned in position. At this stage, the knitting needle is remained in the half stitch position, the latch 2A is suspended at an elevation about 0.5 mm below the belly 11 of the outer pile sinker 1, the outer pile sinker 1 and the inner pile sinker 2 are moved forwards to the tuck position, enabling the hook of the knitting needle to be hooked on the inner pile 9, the ground yarn to be moved in between the nose 13 of the outer pile sinker 1 and the throat 22 of the inner pile sinker 2, and the outer pile 8 to be set into the throat 12 of the outer pile sinker 1.

Figure 5D:
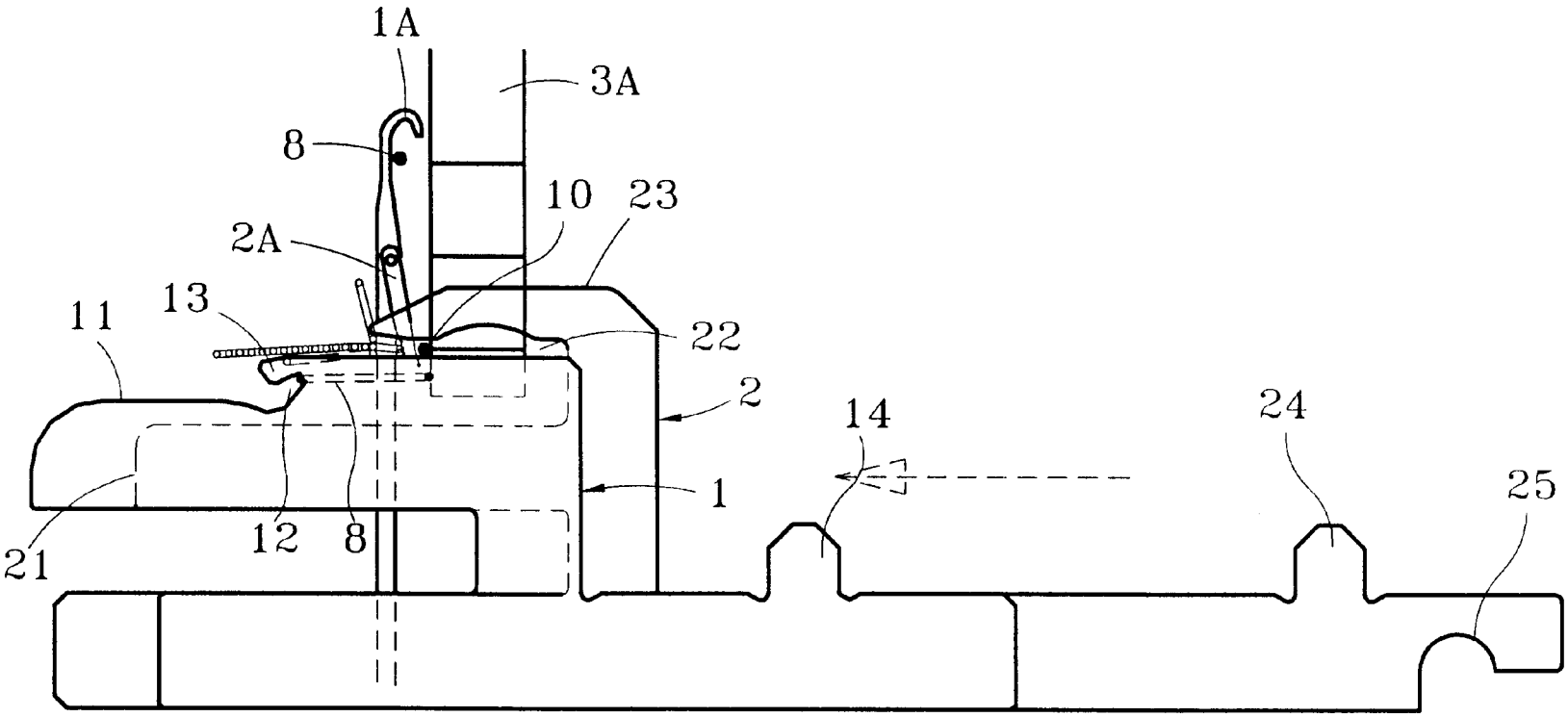
FIG. 5D illustrates a fourth knitting step of the double-loop towel knitting cycle according to the present invention.
Figure 5E:
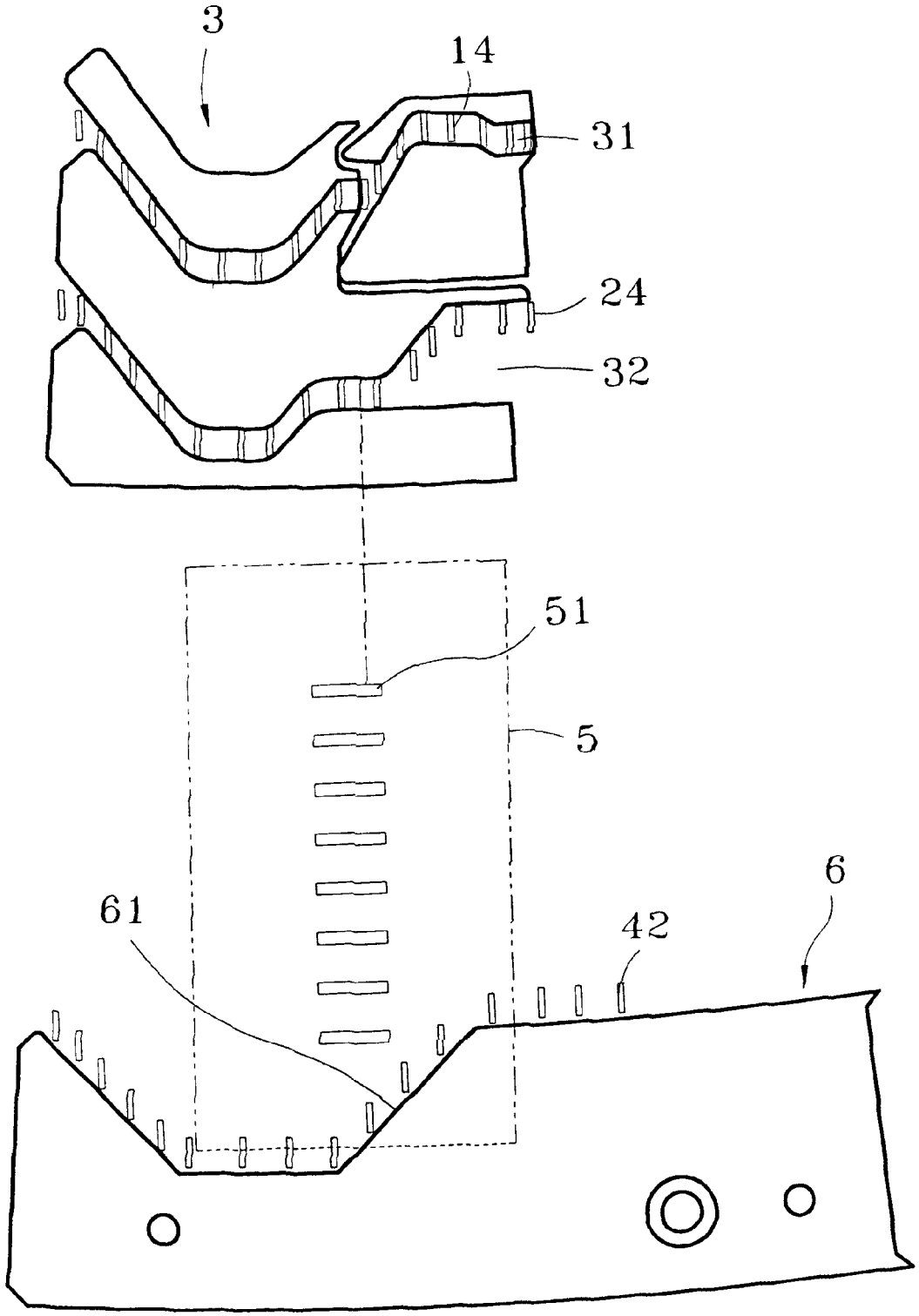
FIG. 5E shows a pile-loop knitting action of the fourth knitting step of FIG. 5D.
Figure 5F:
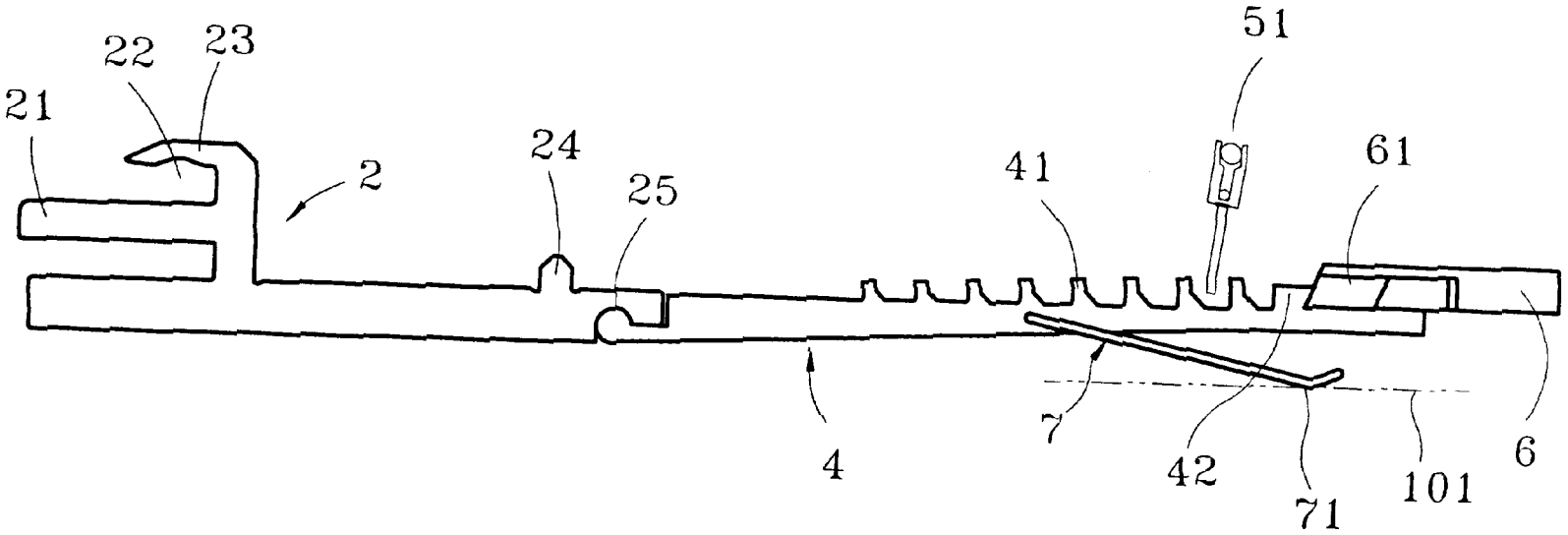
FIG. 5F shows a pile-loop knitting action of the fourth knitting step of FIG. 5D.
Figure 5G:
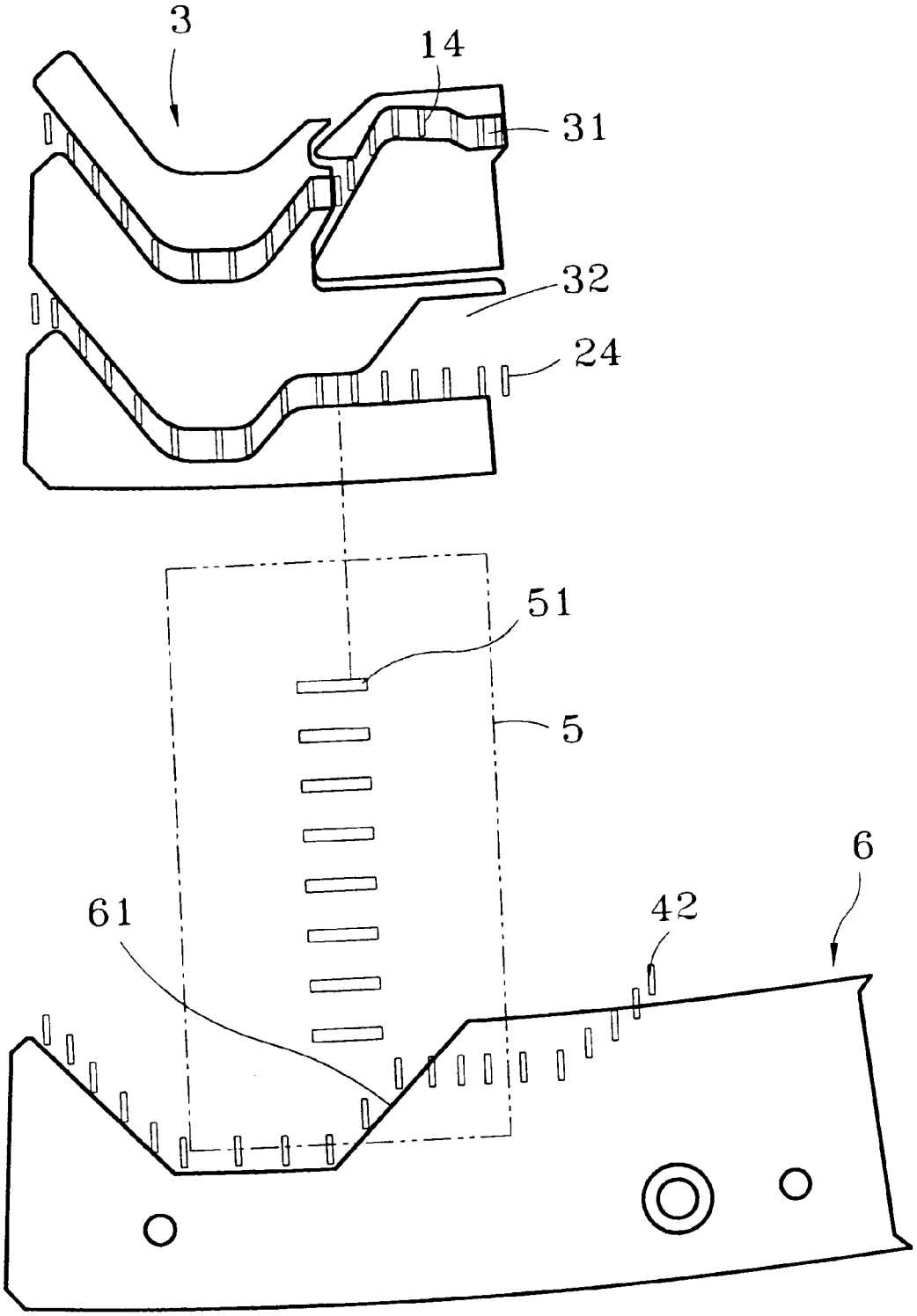
FIG. 5G shows a non-pile pattern knitting action of the fourth knitting step of FIG. 5D.
Figure 5H:
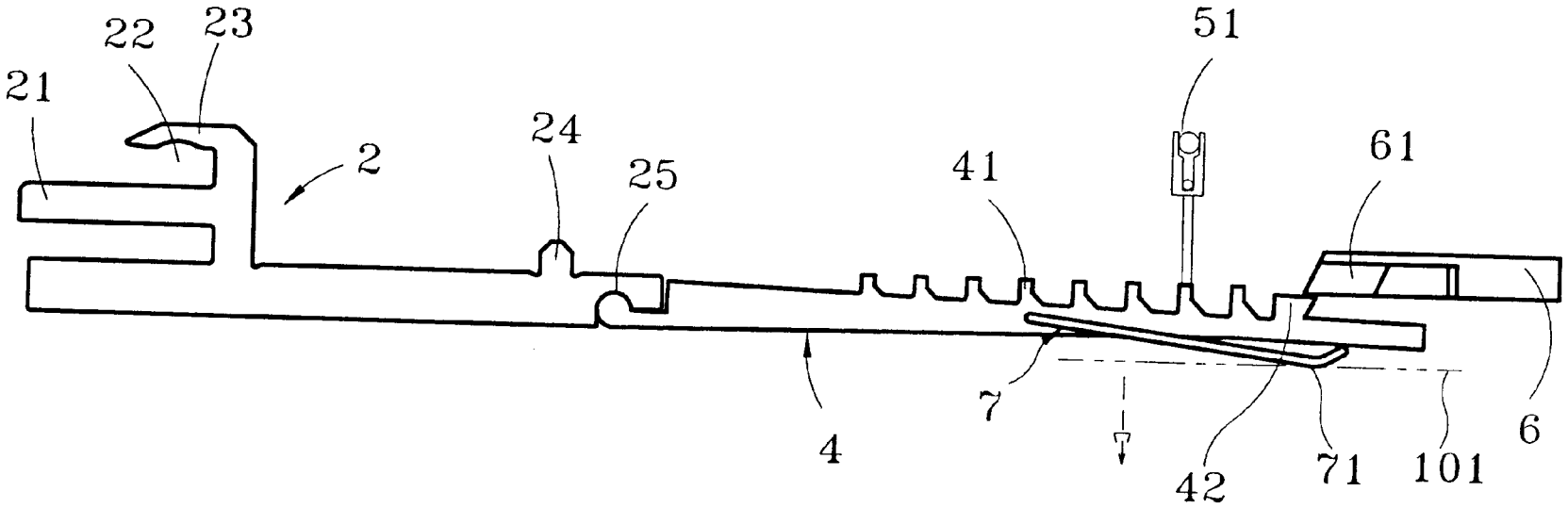
FIG. 5H shows a non-pile pattern knitting action of the fourth knitting step of FIG. 5D.

At the fourth step, as shown in FIG. 5D, the outer pile sinker 1 is moved forwards to form an outer pile loop, then the computer gives a signal to the selector 5, causing the corresponding selector lever 51 to be or not to be pressed on the selection jack 4, so that the inner pile 9 is decided to be knitted into a pile loop, or non-pile pattern. When making a pile loop (see FIGS. 5E and 5F), the selector lever 51 does not touch the protruding portion 41 of the selection jack 4, the butt 42 of the selection jack 4 is moved forwards along the actuating portion 61 of the cam 6, enabling the yarn to be pulled by the bottom knitting needle to form a pile loop. When making a non-pile pattern (see FIGS. 5G and 5H), the selector lever 51 is pressed on the protruding portion 41 of the selection jack 4, causing the reset mechanism 7 to be compressed against the cylinder wall 101 of the sinker cylinder. Therefore, the butt 42 of the selection jack 4 is moved over the actuating portion 61 of the cam 6, preventing the inner pile sinker 2 and the bottom knitting needle from making a pile loop. At this stage, only the ground yarn 10 is shown, and no pile loop is presented. The selection jack 4 is pushed out of the needle cylinder by the reset mechanism 7 before next knitting cycle.

Figure 5I:
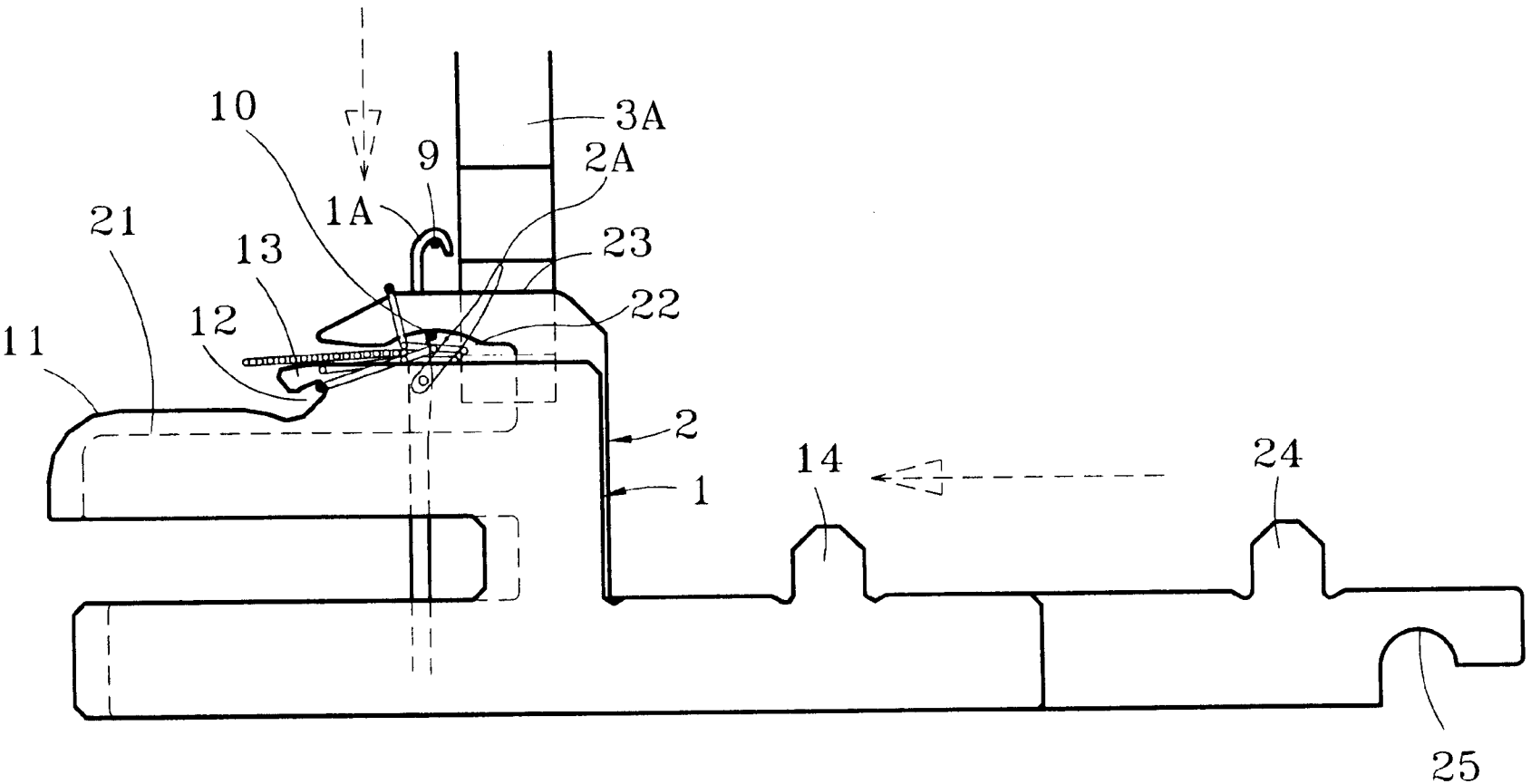
FIG. 5I illustrates a fifth knitting step of the double-loop towel knitting cycle according to the present invention.

At the fifth step, as shown in FIG. 5I, the inner pile 9 is pushed out of the actuating portion 61 of the cam 6, and pulled by the bottom knitting needle 1A to form a pile loop. At the fourth step, pile loop or non-pile pattern knitting operation has been decided. At the fifth step, the bottom knitting needle 1A is driven to hook down the loop. The yarn loop is fed to the throat 12 of the outer pile sinker 1, and the outer pile 8 is slightly released a certain length of time after the sinker has been pushed out, enabling the bottom knitting needle 1A to hook down the loop.

Figure 5J:
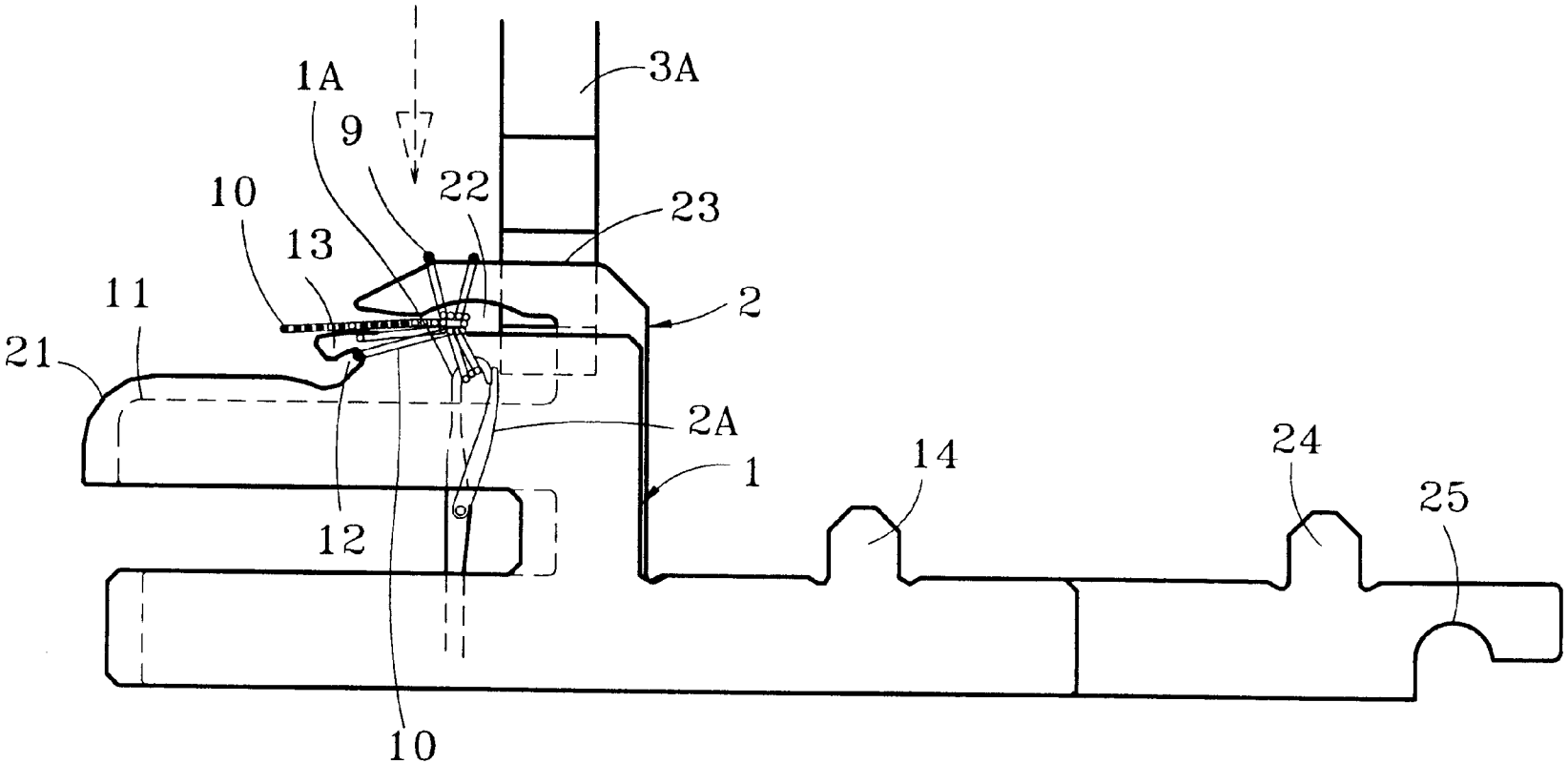
FIG. 5J illustrates a sixth knitting step of the double-loop towel knitting cycle according to the present invention.
Figure 6:
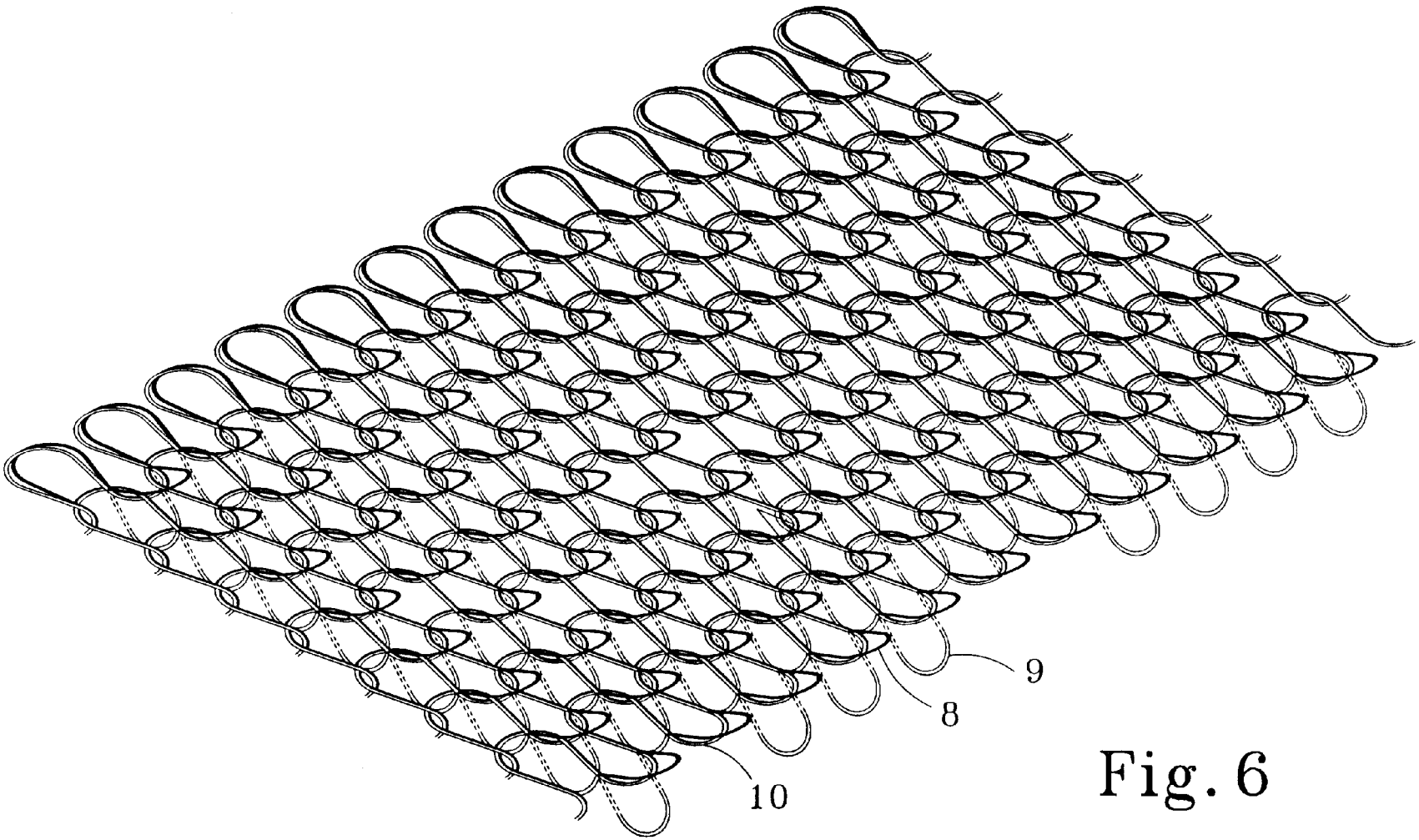
FIG. 6 illustrates a double-loop towel fabric produced according to the present invention.

At the sixth step, as shown in FIG. 5J, the bottom knitting needle 1A pulls down the loop, the inner pile 9, the outer pile 8 and the ground yarn 10 are shown. If the inner pile sinker 2 is pressed in, the sinker cannot be pushed out, no pile loop is produced at this time, and only the ground yarn is seen.

Figure 4B:
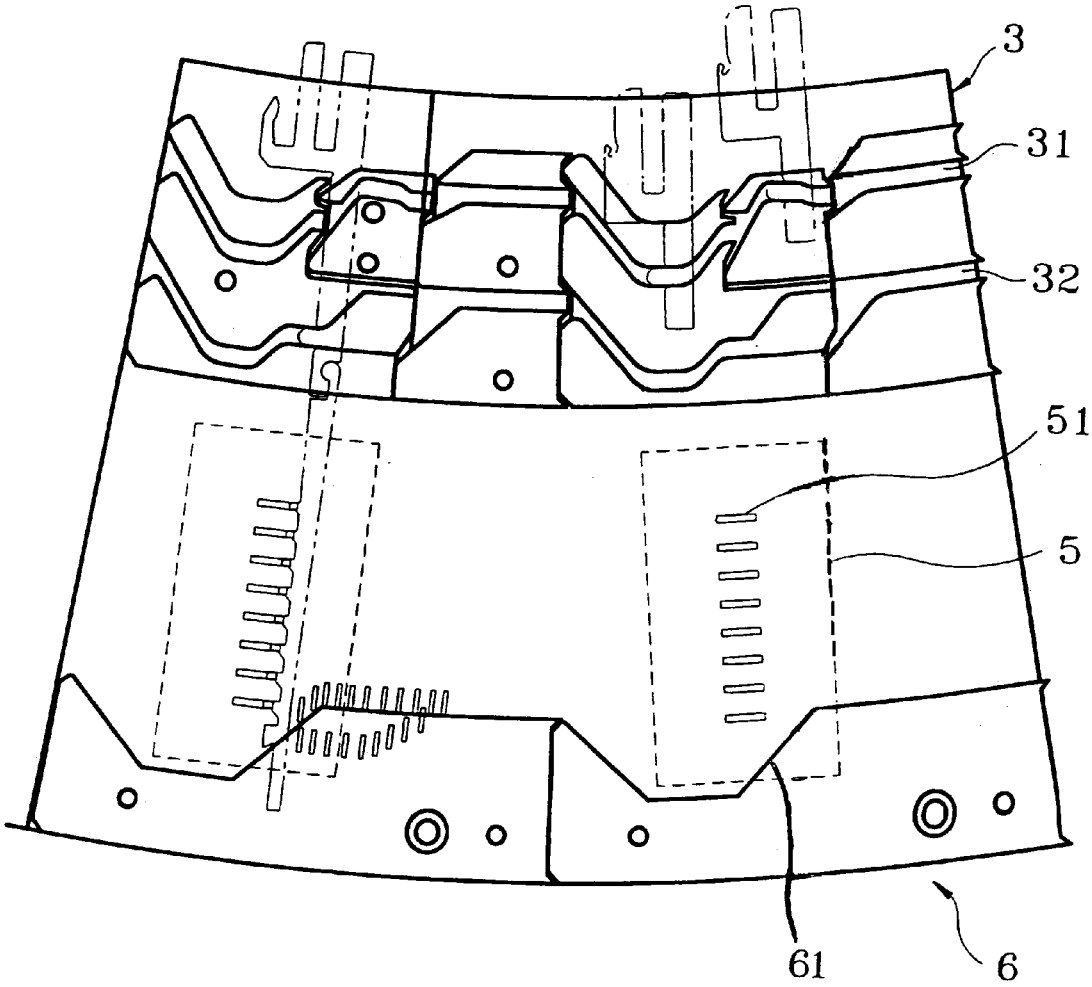

At the seventh step, as shown in FIGS. 4A and 4B, the bottom knitting needle 1A completes a loop and ready for a next knitting cycle, and at the same time the inner pile sinker 2 and the outer pile sinker 1 are pushed forwards to hold down the old loop.

As indicated above, the selection jack 4 is pivoted to the inner pile sinker 2, and controlled by the selector 5 to match with the push cam 6, so that the inner pile is knitted to form a pile loop or non-pile pattern during a double-loop towel knitting operation.

What the invention claimed is:

1. An inner pile jacquard mechanism for a double-loop towel circular knitting machine for knitting a double-loop towel by using a ground yarn and two pile yarns by an outer pile sinker and an inner pile sinker in a sinker cylinder to match with a sinker cap, the inner pile jacquard mechanism comprising an inner pile sinker having a rear side, a selection jack pivoted to the rear side of the inner pile sinker of the inner pile jacquard mechanism, a push cam arranged on said selection jack and controlled to push out the inner pile sinker of the inner pile jacquard mechanism, and a selector arranged in said push cam and controlled to let said selection jack be pushed out by said push cam, by controlling said selector to press or not to press on said selection jack, whereby the inner pile of the double-loop towel may be knitted to form either a pile loop or non-pile pattern.

2. The inner pile jacquard mechanism of claim 1 wherein said selection jack comprises a protruding portion, and a butt.

3. The inner pile jacquard mechanism of claim 1 wherein said selector is a computer-controlled selector.

4. The inner pile jacquard mechanism of claim 1 wherein said selector is an electromagnetic valve type selector.

5. The inner pile jacquard mechanism of claim 1 wherein said selector comprises a plurality of selector levers.

6. The inner pile jacquard mechanism of claim 1 wherein said push cam comprises at least one actuating portion for driving the inner pile sinker to knit a pile loop.

7. The inner pile jacquard mechanism of claim 1 further comprising a reset mechanism arranged at said selection jack at a back side for resetting said selection jack after each knitting cycle.

* * * * *